US005087546A

United States Patent [19]

Kanda et al.

[11] Patent Number: 5,087,546

[45] Date of Patent: Feb. 11, 1992

[54] DEVICE FOR CONTINUOUSLY MIXING POWDER AND PROCESS FOR PRODUCING TONER FOR DEVELOPING ELECTROSTATIC IMAGE

[75] Inventors: Hitoshi Kanda, Yokohama; Atsuko Kobayashi, Tokyo, both of Japan

[73] Assignee: Canon Kabushiki Kaisha, Tokyo, Japan

[21] Appl. No.: 446,447

[22] Filed: Dec. 5, 1989

[30] Foreign Application Priority Data

Dec. 7, 1988 [JP] Japan ..... 63-307914
Dec. 7, 1988 [JP] Japan ..... 63-307915

[51] Int. Cl.[5] ..... G03G 9/08; B01F 7/00
[52] U.S. Cl. ..... 430/137; 366/307
[58] Field of Search ..... 430/137; 366/307, 302

[56] References Cited

U.S. PATENT DOCUMENTS

| | | | |
|---|---|---|---|
| 2,612,354 | 9/1952 | Dron | 259/68 |
| 2,774,577 | 12/1956 | Anderson et al. | 259/9 |
| 2,944,877 | 7/1960 | Marco | 23/290.5 |
| 3,047,368 | 7/1962 | Marco | 23/252 |
| 3,488,009 | 1/1970 | Schold | 241/163 |
| 3,807,703 | 4/1974 | Day | 259/7 |
| 4,187,030 | 2/1980 | Godley | 366/319 |
| 4,792,238 | 12/1988 | Yoneyama et al. | 366/307 |
| 4,859,560 | 8/1989 | Nakamura et al. | 430/137 |

FOREIGN PATENT DOCUMENTS

| | | |
|---|---|---|
| 2203986 | 8/1973 | Fed. Rep. of Germany . |
| 689465 | 9/1930 | France . |
| 953603 | 12/1949 | France . |
| 2202719 | 5/1974 | France . |
| 59-147628 | 8/1984 | Japan . |

OTHER PUBLICATIONS

Patent Abstracts of Japan, vol. 8, No. 279 (C-257) [1716], Dec. 20, 1984.

*Primary Examiner*—John Goodrow
*Attorney, Agent, or Firm*—Fitzpatrick, Cella, Harper & Scinto

[57] ABSTRACT

A continuous mixing device for mixing continuously powder, comprising a casing having a mixing chamber inside of the device, a rotary shaft included within said casing, a rotatable stirring blade axially supported with said rotary shaft, and a fixed blade fixed inside of said casing, wherein said stirring blades and fixed blades are provided in plural numbers. A process for producing a toner composition of developing electrostatic latent images, comprising introducing colored particles having at least a binder resin and a colorant, and a powdery additive into a continuous mixing device, said continuous mixing device comprising a casing having a mixing chamber inside of the device, a rotary shaft included within said casing, a rotatable stirring blade axially supported with said rotary shaft, and a fixed blade fixed inside of said casing, wherein said stirring blades and fixed blades are provided in plural numbers; and mixing the colored particles and the powdery additive to obtain a toner composition.

11 Claims, 5 Drawing Sheets

DEVICE FOR CONTINUOUSLY MIXING POWDER AND PROCESS FOR PRODUCING TONER FOR DEVELOPING ELECTROSTATIC IMAGE

BACKGROUND OF THE INVENTION

1. Field of the Invention

This invention relates to a device for mixing powder. Further, the present invention relates to a process for producing a toner for developing electrostatic images in the image forming methods such as electrophotography, electrostatic recording, electrostatic printing and the like.

2. Related Background Art

As the powder mixing device, there have been known such mixers as the vessel rotation type mixer, the vessel fixed type mixer, the fluidized type mixer and the like.

The vessel rotation type mixer rotates a cylindrical or V-shaped vessel as shown in FIG. 5 and FIG. 6. These devices are batchwise and hence continuous treatment is substantially impossible. Further, mixing of powder particles forming a relatively hard agglomerated mass cannot easily effect disintegration. If there is great difference in physical properties in powder starting materials, there is involved a problem that no good final mixed state can be expected. For solving the above problems, there has been made a contrivance to mount a compulsory stirring blade or a baffle in a mixer, but the above problems have not yet been sufficiently solved.

As the vessel fixed type mixer, there are a mixer of the structure in which a stirring screw in which the stirring blade undergoes planetary movement (revolution) within the vessel by rotation of its supporting implement while under rotation (rotation on its own axis) as shown in FIG. 7 or a mixer in which powder is fluidized in a mixing tank by high speed rotation of the blade at the lower part of the mixing tank to effect mixing as shown in FIG. 8.

With the mixer of the construction as shown in FIG. 7, it is difficult to disintegrate an agglomerated mass formed of fine particles.

The device shown in FIG. 8 is a Henschel mixer, and although it is possible to loosen an agglomerated mass to some extent by means of a blade under high speed rotation by the device, but if it is desired to effect sufficient integration, running for a long time is required. In that case, powder generates heat through collision mutually between particles, whereby there is a fear that they may be denatured. With these devices, uniform dispersion is obtained with difficulty, unless an amount is thrown in a certain amount of volume and mixing for a long time of several minutes to several hours is performed. In that case, because the mixing time is long and also the dust concentration is high, there ensues the problem that the particles once dispersed are agglomerated again. Reagglomeration tendency is more marked as the particle size is finer and/or the chargeability of powder is stronger.

Since the mixing device of the system as shown in FIG. 7 and FIG. 8 is batch system, continuous treatment is impossible. Further, it is difficult to perform uniform mixing in all the regions of the mixing vessel.

For example, as the powder, there is a toner for developing the electrostatic image formed by electrophotography.

As the electrophotographic method, there have been known a large number of methods as disclosed in U.S. Pat. No. 2,297,691, Japanese Patent Publications Nos. 42-23910 and 43-24748. Generally speaking, these are methods in which a photoconductive substance is utilized, an electrical latent image is formed on a photosensitive member by various means, subsequently the latent image is developed by use of a toner and the toner image is transferred onto a transfer material such as paper if necessary, followed by fixing by heating, pressure, hot pressure or solvent vapor to obtain a fixed toner image.

The toner to be used in these methods is triboelectrically charged to positive or negative corresponding to the polarity of the electrostatic latent image to be developed.

As the toner to be used in these developing methods, there can be included a pulverized toner obtained by kneading, pulverizing and if necessary, classifying a mixture comprising at least a binder resin and a colorant, a toner obtained by the polymerization method, or a capsule toner.

As the charging method of toner, there may be included (1) the charge injection method in which charges are injected into a toner which is made electroconductive, (2) the dielectric polarization method utilizing dielectric polarization under electrical field, (3) the ion stream charging method in which a shower of charged ions is poured on the particles by such means as corona charger, (4) the frictional charging method in which a toner is rubbed with a material at the position different in triboelectric charging series from the toner. Among them, in the charge injection method, it is difficult to transfer a toner image onto a material to be fixed such as paper from the latent image surface, because the toner is electroconductive. In the dielectric polarization, it is very difficult to produce sufficiently great charges.

On the other hand, according to the charging method by an ion charger, technical difficulty is involved in exposing a toner uniformly to ion stream, whereby it is extremely difficult to control the charging amount with good reproducibility.

The triboelectric charging method uses electrically insulating toner particles, can impart sufficient charging amount to the toner and also has reproducibility, and hence has been presently used widely. However, since the triboelectric charges are in proportion to the frictional work amount, it is difficult to make the frictional work amount of toner particles always at a constant level in the practical development, whereby excess or shortage of charges may occur, or influence from environmental conditions, particularly humidity, may be exerted.

Toner may be attached on the carrier which is in contact with the toner and imparts triboelectric charges to the toner and/or the surface of the sleeve of developing instrument, and through gradual increase of the toner attached, the triboelectric characteristic values of the carrier and the sleeve are caused to be change. As the result, there is also a tendency that deterioration phenomenon of copy image quality occurs when a large number of copies are taken.

As the means for solving this problem, it has been proposed to add fine particulate powdery colloidal silica alone or together with another functional material into a developing agent. For example, there are Japanese Patent Publication No. 54-16219 (corresponding to U.S. Pat. No. 3,720,617) and Japanese Patent Application Laid-open Nos. 55-120041 and 53-81127. Even silica itself has been improved with an aim to control hydrophobicity or chargeability as shown in Japanese Patent Application Laid-open Nos. 58-60754, 58-186751 and 59-200252 (corresponding to U.S. Pat. No. 4,568,625).

However, as the method for adding these, mere addition, or, mixing with stirring blades of a mixer such as Henschel mixer as shown in FIG. 8 or Papenmeier at a circumferential speed of several m/sec. to 40 m/sec. has been generally practiced. In Henschel mixer, through the rotation of the blades fixed on the rotation axis at the central portion, the colored particles and an additive such as silica are dispersed, whereby a part of the additive is attached electrostatically onto the surface of colored particles, and further a part exists under free state to contribute to the flowability of the colored particles. However, according to this method, the circumferential speed is greatly different at the vicinity of the rotary axis portion at the central portion from that of the tip of the stirring blade, and also since there is no blade-like member at the rotary axis portion, the stirring force and dispersing force will differ partially internally of the device to give readily nonuniform dispersed state. For this reason, irregularity occurs in the state of silica attached onto the colored particle surface, and also color particles (toner particles) attached with poorly dispersed silica are formed. Such silica will be readily freed from the colored particles. The freed silica is liable to be consumed by copying to reduce the amount of silica in the developing instrument, thereby causing lowering in the flowability of colored particles or lowering in the image density, and also the freed silica agglomerated may also cause increase of fog.

In a mixer of the structure such as Henschel mixer, mixing is effected batchwise, and hence the dust concentration during mixing is high, and if uniform dispersion is intended to be effected, it will generally take a long time of several minutes to several 10 minutes. For this reason, the particles once dispersed are susceptible to reagglomeration, whereby heat generation is liable to occur by mutual friction of the particles and friction of particles with blades to form a fused product. When the agglomerated body or fused product formed is mixed into the toner as the final product, lowering in the toner quality will be caused to occur.

On the other hand, there has been also known for long time the thought of securing powdery silica onto the surface of colored particles. One method is to add powdery silica together with a binder for the colored particles, colorant, charge controller, etc., melting and kneading the mixture, cooling the kneaded product, followed by pulverization and, if necessary classification, to form a toner. However, when a toner is produced according to this method, silica exists on the toner surface and in the vicinity thereof, and for obtaining sufficient effect, a large amount of silica must be added during melting and kneading. This is not only accompanied with considerable difficulty in production, but also may be a cause in lowering of fixability, which is particularly conspicuous in thermal fixing toner. According to such method, since the ammount of silica existing on the toner surface is small, the improvement of such problems in image quality cannot be said to be sufficient, although some improvement can be seen. As to addition of silica into toner, examples are shown in Japanese Patent Publication No. 44-18995, Japanese Patent Application Laid-open Nos. 51-81623 and 56-1946.

As the means for dispersing silica onto the surface of colored particles, there is a method in which colored particles and silica powder are added, mixed and heated to the softening point or higher to secure the powder onto the surface of the particles, as exemplified by Japanese Patent Application Laid-open Nos. 54-2741 and 57-125943. However, according to this method, there is a danger that fusion of colored particles may be caused to occur.

SUMMARY OF THE INVENTION

An object of the present invention is to provide a device for dispersing sufficiently and mixing uniformly two or more kinds of powder.

Another object of the present invention is to provide a powder mixing device capable of continuous operation.

Still another object of the present invention is to provide a device which mixes efficiently and uniformly two or more kinds of powder with average particle size of 100 μm or less.

Still another object of the present invention is to provide a process for producing a toner which has solved the problems as described above.

Still another object of the present invention is to provide a process for producing efficiently a toner for electrostatic image development of good quality.

In accordance with an aspect of the present invention, there is provided a continuous mixing device for mixing continuously powder, comprising a casing having a mixing chamber inside of the device, a rotary shaft included within said casing, a rotatable stirring blade axially supported with said rotary shaft, and a fixed blade fixed inside of said casing, wherein said stirring blades and fixed blades are provided in plural numbers.

In accordance with another aspect of the present invention, there is provided a process for producing a toner composition for developing electrostatic latent images, comprising introducing colored particles having at least a binder resin and a colorant, and a powdery additive into a continuous mixing device, said continuous mixing device comprising a casing having a mixing chamber inside of the device, rotary shaft included within said casing, a rotatable stirring blade axially supported with said rotary shaft, and a fixed blade fixed inside of said casing, wherein said stirring blades and fixed blades are provided in plural numbers; and mixing the colored particles and the powdery additive to obtain a toner composition.

DETAILED DESCRIPTION OF THE PREFERRED EMBODIMENT

Figure 1A:
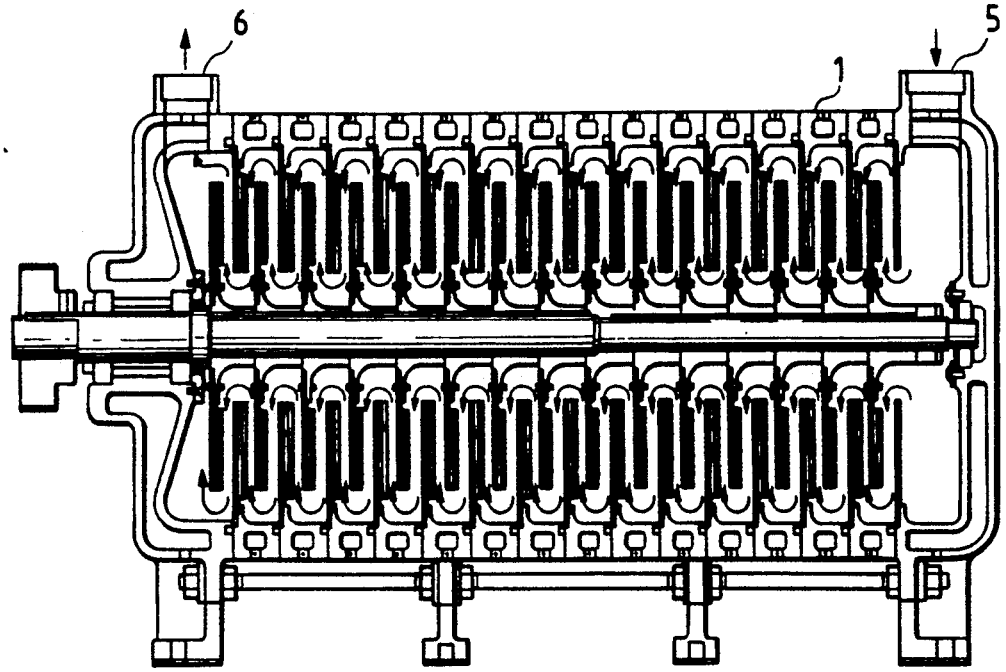
FIG. 1A is a schematic sectional view of an example of the continuous mixing device of the present invention.
Figure 1B:
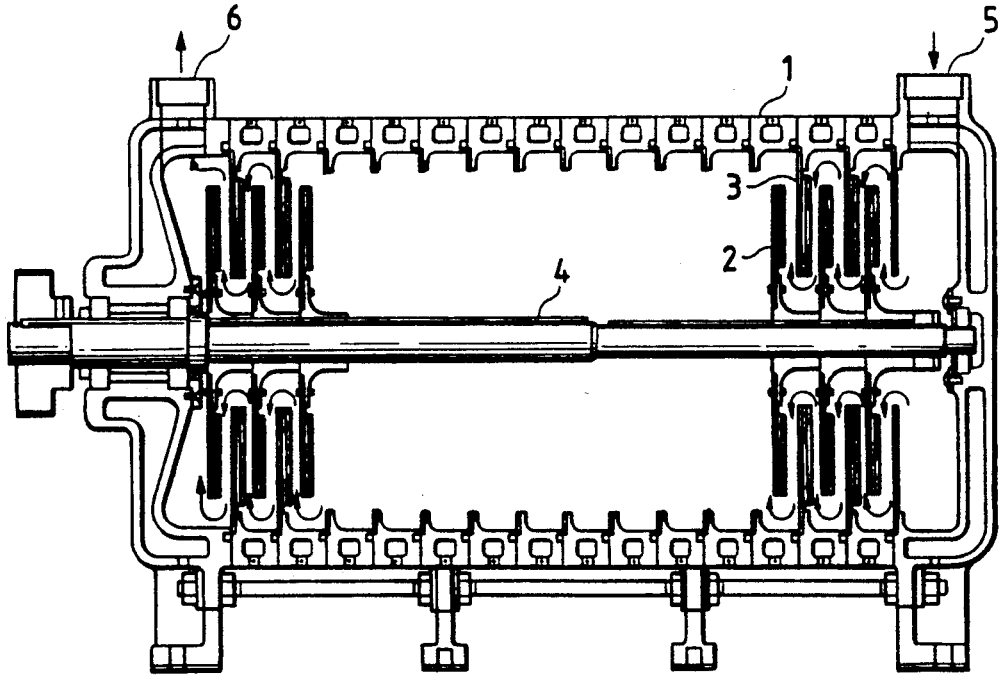
FIG. 1B shows an illustration of the device at the central portion shown in FIG. 1A from which stirring blades and fixed blades are omitted.

The continuous mixing device of the present invention is described by referring to an example shown in FIG. 1A and FIG. 1B.

The continuous mixing device shown in FIG. 1A and FIG. 1B is equipped with casing 1 for forming mixing chamber, stirring blades 2 capable of high speed rotation, fixed blades 3 fixed on the casing, rotary shaft 4 supporting axially the stirring blades rotatably, introduction inlet 5 and discharging outlet 6.

Figure 2A:
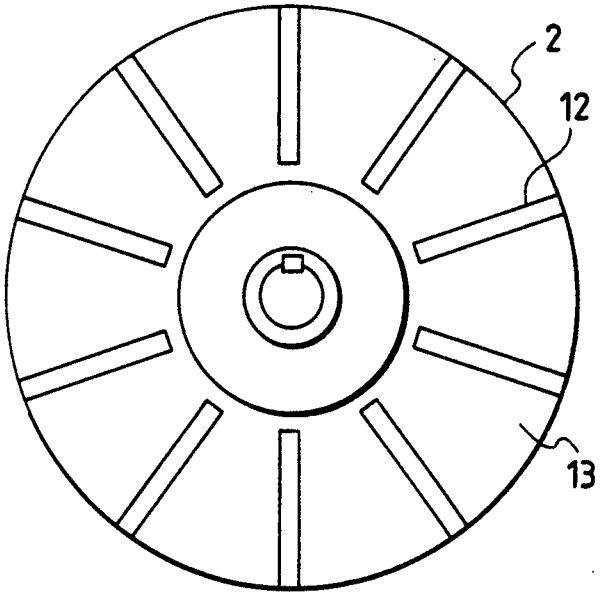
FIG. 2A shows a front view of the stirring blade used in the device shown in FIG. 1A.

FIG. 2A is a front view of the stirring blade 2 used in the device shown in FIG. 1A and FIG. 1B, which stirring blade 2 is constituted of rotary plate (preferably disc) 13 and blade 12 mounted on the rotary plate 13.

Figure 2B:
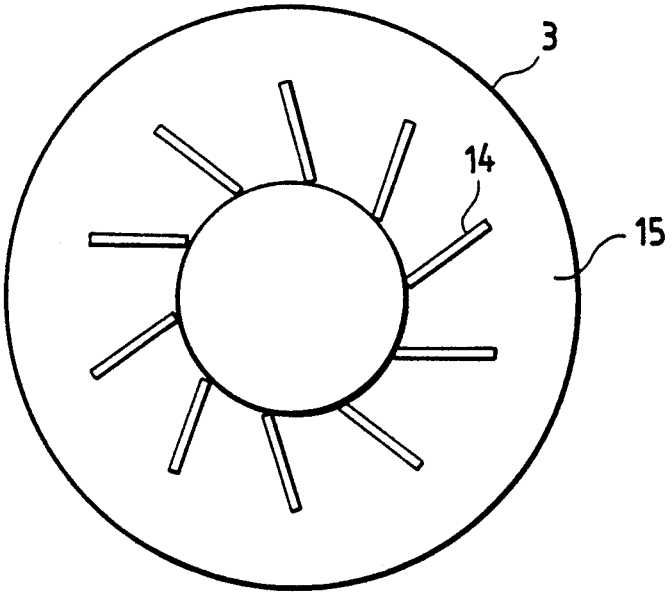
FIG. 2B shows a front view of the fixed blade used in the device shown in FIG. 1A, and FIGS. 5 through 8 are schematic illustrations showing a mixer of the prior art.

FIG. 2B is a front view of the fixed blade 3 to be used in the device shown in FIG. 1A and FIG. 1B, and the fixed blade 3 is constituted of annular fixed plate (preferably disc) 15 and blades 14 mounted on the annular fixed plate 15.

In the continuous mixing device, stirring blades 2 axially supported by rotary axis 4 and fixed blades 3 are provided in multiple stages, and the powder is uniformly dispersed and mixed by high speed rotation of the stirring blades 2.

The powder to be mixed is thrown through the introducing inlet 5, dispersed and mixed by the stirring blades 2 rotating at high speed and the fixed blades 3, delivered to the next zone through the gaps between the respective fixed blades 3 and the rotary shaft 4 in the vicinity thereof, and again dispersed and mixed by the stirring blades and the fixed blades. As shown by the arrowhead shown in FIG. 1A, the powder is delivered while being successively dispersed and mixed surely between the stirring blades 2 and the fixed blades 3, until finally it is taken out of the continuous mixing device through the discharging outlet 6.

Figure 4:
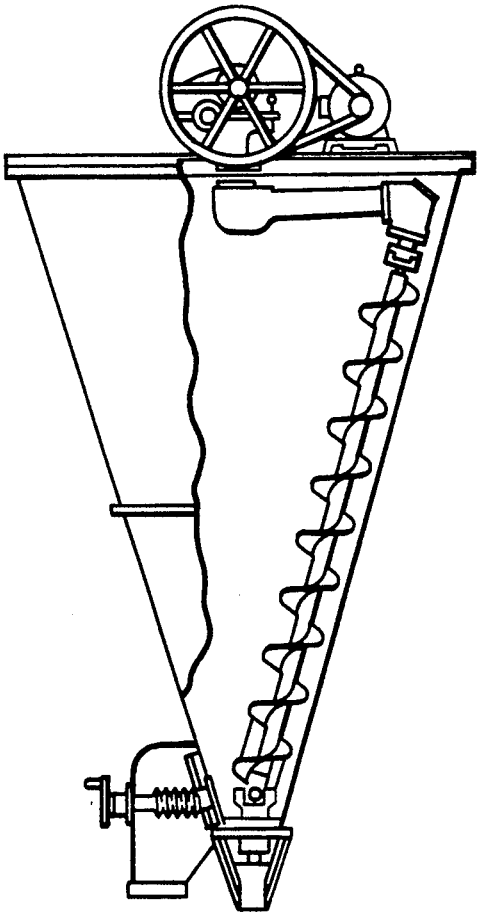
FIG. 4 shows a schematic illustration of an example of the mixing device for preliminary mixing of the powder introduced into the continuous mixing device of the present invention.
Figure 5:
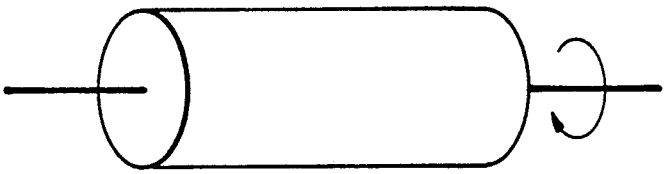
Figure 6:
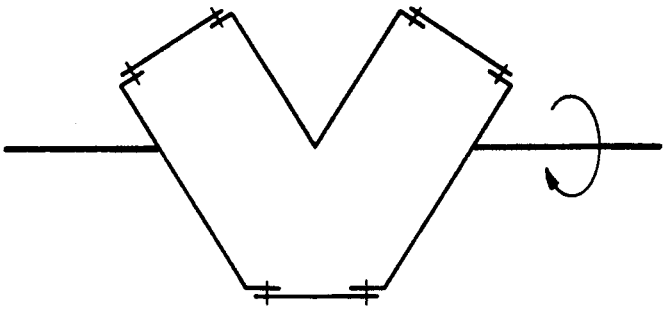
Figure 7:
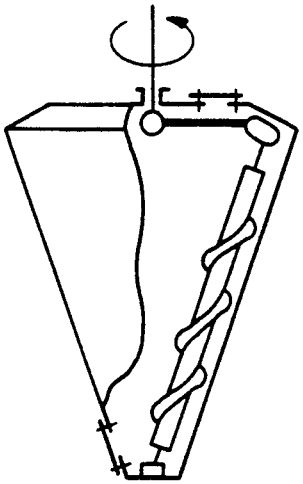

For performing mixing in the continuous mixing device more effectively, it is effective to mix previously two or more kinds of powder to be mixed by means of, for example, a mixing device shown in FIG. 4 before mixing by means of the continuous mixing device, thereby forming a state macroscopically dispersed. By this, mixing in the present device can be aided to give a mixture dispersed highly uniformly. The numbers of the stirring blades 2 and the fixed blades 3 may be set as desired depending on the desired mixed state. For obtaining good dispersed state, three (3) or more each of the stirring blades 2 and the fixed blades 3 may be employed to provide three (3) or more communicating stirring zones.

The circumferential speed of the tip portion of the stirring blade 2 may be preferably 20 m/sec. to 100 m/sec., more preferably 30 m/sec. to 80 m/sec., to give better mixed state.

The stirring blades 2 may have a diameter of 10 to 100 cm, preferably 15 to 50 cm. Further, the rotation number of the stirring blades 2 may be 500 to 10,000 rpm, preferably 1,000 to 7,000.

The dust concentration during mixing (amount of powder thrown per second/amount of air transported per second) may be more preferably 0.1 $Kg/m^3$ to 20 $Kg/m^3$.

In a batch system mixer of the prior art shown in FIG. 5 to FIG. 8, mixing is performed at a dust concentration generally of 100 $Kg/m^3$ or more in the container. In contrast, in the continuous mixing device of the present invention, since mixing is performed continuously at a dust concentration of 1/5 of that of the prior art, the mixing efficiency and dispersing efficiency are good, whereby agglomerated product of fine powder is formed with difficulty. For making the dust concentration small in a batch system mixer of the prior art, the amount thrown (throughput at one time) may be made smaller, but in that case, the treatment ability is extremely reduced to cause undesirably lowering in production efficiency.

In the continuous mixing device of the present invention shown in FIG. 1A, the mixture to be mixed passes surely through the gaps between the fixed blades 3 and the rotary blades 2, whereby at every time the mixture is dispersed and mixed by the rotary blades 2 and the fixed blades 3, and therefore uniform and sufficient mixed state and dispersed state can be obtained without occurrence of poor mixing.

In the continuous mixing device of the present invention, the mixing operation is performed continuously by one pass, and therefore the mixing time is very short as several seconds to improve extremely productivity.

Further, since the mixing time is short, heat generation is also small, with less generation of thermal fusion of powder as compared with the prior art device. When materials which are apt to thermally readily melt are mixed, the continuous mixing device may be also cooled for inhibiting heat generation.

The shapes of the fixed blades 3 and the rotary blades 2 are not limited to those shown in FIG. 1A, FIG. 2A and FIG. 2B, but may be also varied depending on the characteristics of the powder to be treated, and the desired mixed state.

The continuous mixing device of the present invention is suitable for mixing of fine powder. Particularly, it is effective when ultra-fine powder with primary particle sizes of 1 μm or less and powder with particle sizes greater than that are to be uniformly mixed. Such ultra-fine particle is very susceptible to agglomeration, rarely existing themselves as primary particles but existing as agglomerated body. For mixing such ultra-fine powder with other powder, the agglomerated body of the ultra-fine powder is demanded to be loosened sufficiently to be dispersed sufficiently, and mixed uniformly. The mixing device of the prior art is unsatisfactory for loosening agglomerated body, and, even if loosening can be effected, it will take a long time. In contrast, in the continuous mixing device of the present invention, satisfactory dispersion can be obtained because it performs dispersing surely with stirring blades and fixed blades, and yet is constituted of multiple stages, whereby agglomerated body comprising ultra-fine powder can be loosened to give a mixture in uniform mixed state.

As described above, by the continuous mixing device according to the present invention, powder can be surely dispersed and mixed by the stirring blades, fixed blades provided in multiple stages. Also, due to low dust concentration, reagglomeration of powder will occur with difficulty. Besides, continuous operation is possible.

Next, the case when the powder is a toner is to be described.

In an insulating toner, it is important to control constantly the amount of triboelectric charging. For obtaining a good toner image even under different environment and, even in continuous image formation, for obtaining a good toner image which is not different from that in the initial stage, what is important resides in how the triboelectric charging amount of the toner is controlled. In general, by improvement of the triboelectric charging characteristic of toner, the absolute amount of the toner tends to be increased. Particularly, under low humidity environment, it becomes necessary to create a great electrical field for transferring the toner onto the latent image face on account of its excessive charging amount, whereby there is possibility of the risk of load on the system or discharging by dielectric breakdown.

On the other hand, if charging amount of toner is suppressed, particularly under high humidity environment, it will take a time for having sufficient amount of triboelectric charges, and a toner to be attached on other portions than the latent image portion with forces other than electrical force is liable to be formed to ensue the problem of contamination of toner image.

For solving such problem, it has been known to attach uniformly an additive such as silica powder onto the surface of colored particles forming the toner, thereby to control the triboelectric charging characteristic. At this time, silica powder is required to be sufficiently loosened and attached under the uniformly dispersed state on the surface of colored particles, and preferably attached uniformly on the individual colored particles.

Figure 8:
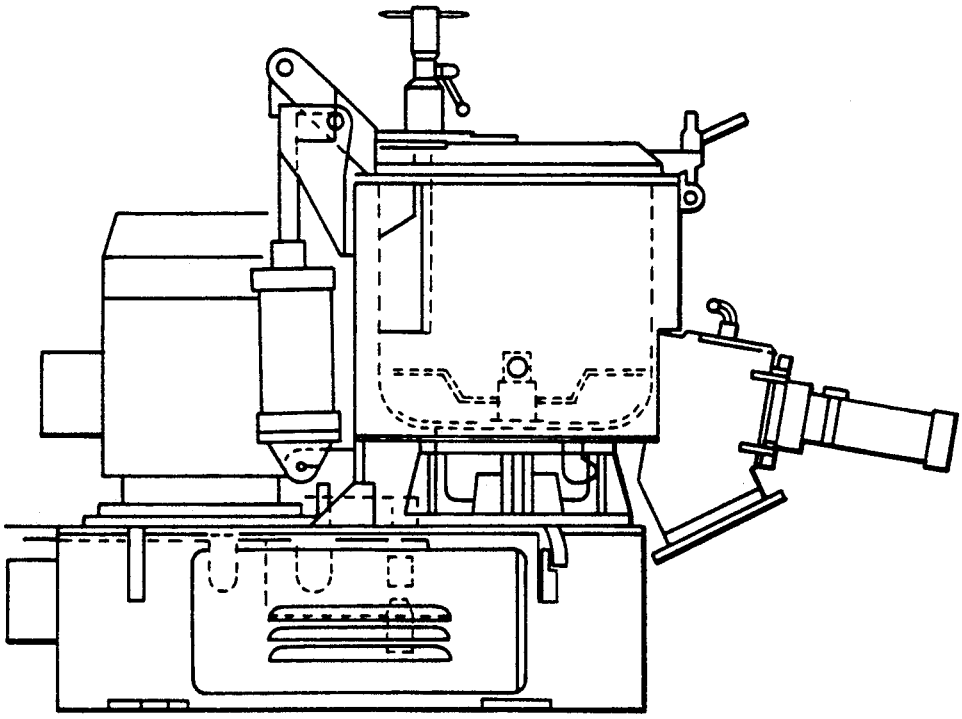

In the prior art, for example, the colored particles and silica powder have been mixed in a mixing device as shown in FIG. 8. When a device shown in FIG. 8 is used, sure dispersing with blades can be done with difficulty.

In the present invention, by use of a continuous mixing device as shown in FIG. 1A, it is possible to form a toner efficiently by mixing well colored particles with silica powder.

The colored particles and silica powder are thrown through the introducing inlet 5, dispersed and mixed with stirring blade 2 under high speed rotation and fixed blade 3, delivered through the gaps between the respective fixed blade 3 and the rotary shaft 4 in the vicinity to the next zone, where they are again dispersed and mixed by the stirring blade and fixed blade. As shown by the arrowhead shown in FIG. 1A, the mixture of the colored particles and the silica powder are delivered while being dispersed and mixed between the stirring blades 2 and the fixed blades 3, until finally taken out of the continuous mixing device through the discharging outlet 6.

Figure 3:
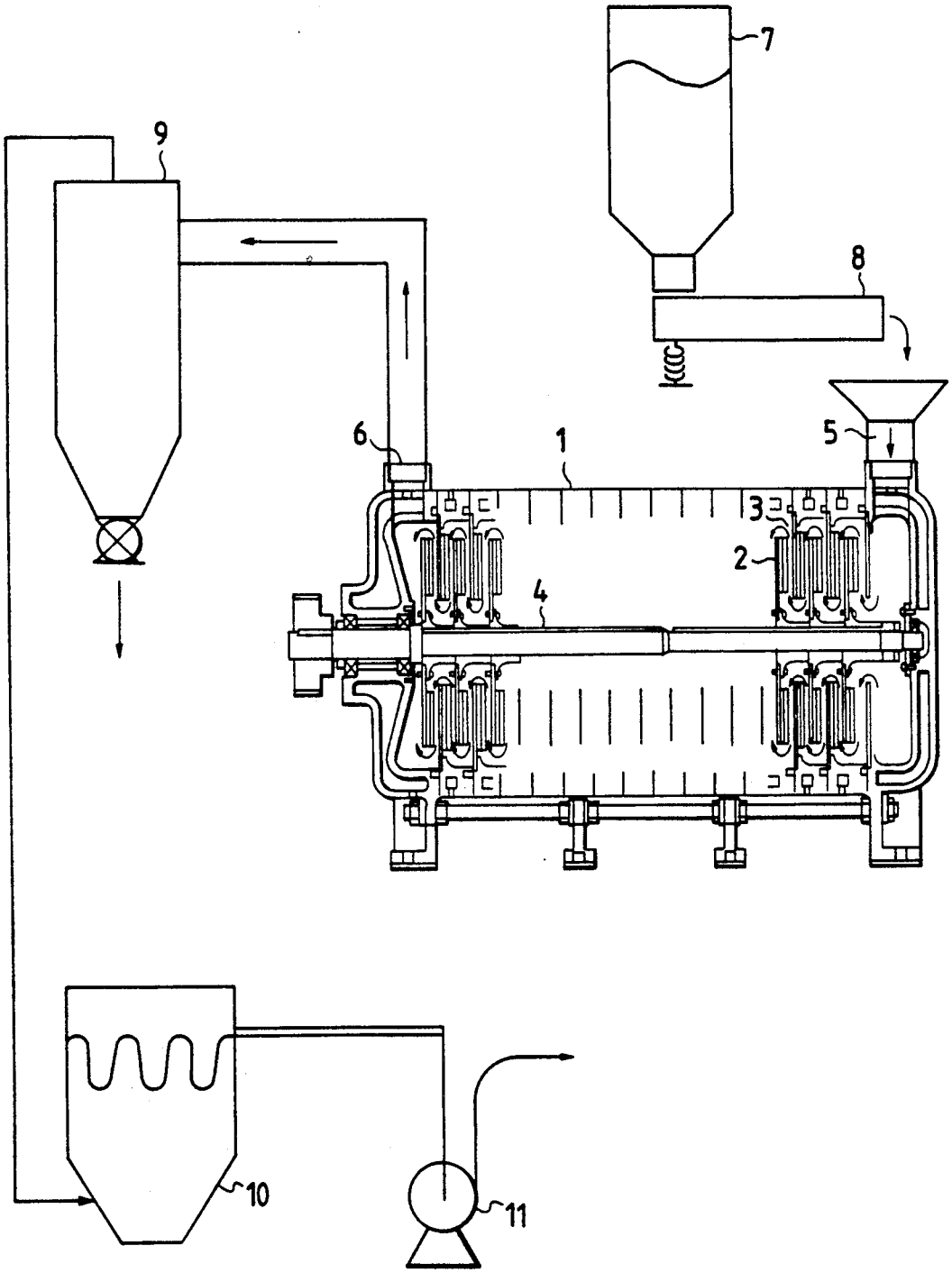
FIG. 3 shows an example of the flow chart during production of a toner by use of the device shown in FIG. 1A.

FIG. 3 shows a flow chart of a preferable system when a toner composition is produced by use of the continuous mixing device shown in FIG. 1A. The production system shown in FIG. 3 has starting material hopper 7, vibration feeder 8, collection cyclone 9, bag filter 10 and blower 11.

In the continuous mixer, the colored particles and the additive pass through the gaps between the fixed blade and the rotary blade to be dispersed and mixed every time of passing, and therefore mixing efficiency is good. When the additive is silica, agglomerated mass of silica is surely loosened to dissociate free silica under agglomerated state.

Further, for effecting mixing of the colored particles and the powdery additive in the present device, it is effective to stir lightly the colored particles and the additive previously before mixing by the present device, thereby attaching the additive dispersed macroscopically onto the surface of colored particles.

In this case, efficiency of mixing by the continuous mixing device is made better to give a toner of high quality. As the pre-mixer, for example, a device of the system shown in FIG. 4 (Nauta mixer: manufactured by Hosokawamicron Co.) can be used.

In production of a toner, the number of stages of the stirring blades 2 and the fixed blades 3 may be set as desired depending on the desired mixed state. Preferably, 3 or more stages may be employed. The circumferential speed of the tip portion of the stirring blade 2 may be preferably 20 m/sec. to 100 m/sec., more preferably 30 m/sec. to 80 m/sec., to give better mixed state. The dust concentration during mixing (amount of mixture of colored particles and powdery additive per second/amount of air transported per second) may be more preferably 0.1 $Kg/m^3$ to 20 $Kg/m^3$.

On the other hand, the colored particles to be used in the present invention can be obtained according to, for example, the process as described below. As the colored particles according to the pulverization method, there may be employed those obtained by melting and kneading a mixture comprising at least a binder resin and a colorant, pulverizing after cooling by a known pulverizer and classifying the product, if necessary, to have a uniform particle size distribution. The volume average particle size of colored particles preferable as a toner for developing is 2 to 20$\mu$. Colored particles obtained by the polymerization or encapsulated colored particles may be also employed.

In the process of the present invention, since mixing of colored particles and additive is performed continuously by one pass, mixing time is as short as several seconds to improve productivity to great extent. Since the mixing time is short, heat generation is also small, whereby occurrent of a fused product is little as compared with the case of the prior art device, and the continuous mixer may be also cooled for suppressing heat generation when materials susceptible to fusion are to be mixed.

Next, a preferable process for producing toner is described by referring to a device flow chart shown in FIG. 3.

A composition containing at least a binder resin and a colorant is melted and kneaded, and the kneaded product is cooled to be solidified. The solidified product is pulverized to form a pulverized starting material. The pulverized starting material is classified, if necessary, and the colored particles obtained and a powdery additive such as silica are thrown into Nauta mixer as shown in FIG. 4 to obtain a preliminarily mixed product. The preliminarily mixed product obtained is thrown into the starting material hopper 7, and via the vibration feeder 8, introduced through the introducing inlet 5 into the casing 1 of the continuous mixing device. The preliminarily mixed product is dispersed and mixed continuously in the continuous mixer, then discharged through the discharging outlet 6, collected by the collection cyclone 9 equipped with bag filter 10 and blower 11 and recovered as a toner product. It was confirmed by observation by an electron microscope that silica was finely and uniformly attached on the surface of the colored particles. No presence of free silica agglomerated could be found.

The present invention is described in detail below by referring to Examples.

The particle size representation in Examples is according to measurement by Coulter counter TA-II Model (100μ aperture).

EXAMPLE 1

| | |
|---|---|
| Styrene-acrylic acid ester type resin (weight average molecular weight: about 300,000) | 100 wt. parts |
| Magnetite (BET value 8 $m^2/g$) | 60 wt. parts |
| Low molecular weight polyethylene | 2 wt. parts |
| Chromium complex of di-tertbutyl salicylate | 2 wt. parts |

The toner starting material comprising the above mixture was melted and kneaded at about 180° C. for about 1.0 hour, cooled to be solidified, coarsely crushed by a hammer mill and then pulverized by a supersonic jet mill (manufactured by Nippon Pneumatic Kogyo) to obtain a pulverized product with a weight average particle size of 10.5 μm (having 9.3% by weight of particles with particle size of 5.04 μm or less). From the pulverized product obtained, fine powder and coarse powder were removed by classification by means of two DS classifying machines (manufactured by Nippon Pneumatic Kogyo) to obtain colored particles with a volume average particle size of 11.5 μm (containing 0.3% by weight of particles with an average particle size of 5.04 μm or less). 100 Parts of the colored particles obtained and 0.3 part by weight of the silica fine powder were thrown into Nauta mixer shown in FIG. 4 to carry out preliminary mixing. When the preliminarily mixed product obtained was observed by an electron microscope, the silica fine powder was found to be macroscopically dispersed under agglomerated state.

Next, the preliminarily mixed product was subjected to dispersing mixing according to the flow shown in FIG. 3. The preliminarily mixed product was thrown into the starting material hopper 7 and, via the vibrating feeder 8, introduced through the introducing inlet 5 into the casing 1 of the continuous mixing machine to be mixed therein, and after mixing the powder discharged through the discharging outlet 6 was collected by the cyclone 9 to obtain a product toner.

Mixing was conducted with the use of 15 stirring blades 2 and 14 fixed blades 3 combined alternately to form 15 communicating stirring zones, under the conditions of a circumferential speed 50 m/sec. of the tip portion of the stirring blade 2, with diameter of the stirring blade 2 of 30 cm, length of the blade 12 of 8 cm, longer diameter of the fixed blade 3 of 37 cm, inner diameter of the fixed blade of 15 cm, length of the blade 14 of 9 cm, gap between the stirring blade 2 and the fixed blade 3 of about 1 cm, gap between the tip of the stirring blade 2 and the casing 1 of about 3 cm, gap between the inner peripheral of the fixed blade 3 and the rotary shaft 4 of about 4 cm, length of the casing 1 of about 100 cm, at rotation number of the stirring blade of 3200 rpm, and at a powder dust concentration of 1 $Kg/cm^3$.

The residence time of the powder in the continuous mixing device was about 2 to 3 seconds, and about 2 Kg/min. of the toner was obtained.

When the toner obtained was observed by an electron microscope, most of the silica fine powder was found to be dispersed substantially to primary particles and attached uniformly on the surface of colored particles. No agglomerated body of free silica could be found.

The toner obtained was thrown into a copying machine NP270RE manufactured by Canon, and development was carried out. As the result, a good image with an image density of 1.30 was obtained, with little fog, and no increase of fog was seen even when left to stand in an atmosphere temperature of 35° C. under a high humidity of 90% RH for 10 days.

EXAMPLE 2

The colored particles obtained in Example 1 and silica fine powder were preliminarily mixed similarly as described in Example 1, and mixing was carried out according to the flow shown in FIG. 3.

The mixing was conducted under the conditions of 5 stages of stirring blades 2 and fixed blades 3 (5 stirring blades), circumferential speed of the tip portion of stirring blade of 70 m/sec., and dust concentration of 0.8 $Kg/m^3$. The residence time of the powder in the continuous mixing machine was about 1 sec.

When the toner obtained was observed by an electron microscope, it could be confirmed that most of the silica fine powder was dispersed to primary particles and attached uniformly on the surface of colored particles. No agglomerated body of free silica could be found.

The toner obtained was thrown into a copying machine NP270RE manufactured by Canon and development was carried out. As the result, a good image without fog was obtained. No increase of fog was seen even when left to stand in an atmosphere temperature of 35° C. under a high humidity of 90% RH for 10 days.

EXAMPLE 3

| | |
|---|---|
| Styrene-butyl methacrylate (weight ratio 7:3) copolymer | 100 wt. parts |
| Magnetite (BET value 8 $m^2/g$) | 65 wt. parts |
| Nigrosine | 2 wt. parts |
| Polypropylene wax | 3 wt. parts |

The above components were mixed, and melted and kneaded at 160° C. by a roll mill. After cooling, the kneaded product was coarsely crushed by a hammer mill and then pulverized by a jet mill pulverizer, followed by classification by use of a wind force classifier to obtain a colored product with a volume average particle size of 12.0 μm.

100 Parts of the colored particles obtained and 0.4 part by weight of silica fine powder were thrown into Nauta mixer shown in FIG. 4 to carry out preliminary mixing, and subsequently mixing was carried out according to the flow shown in FIG. 3 similarly as in Example 1 to obtain a product toner.

The mixing conditions were 15 stages of stirring blades 2 and fixed blades 3 (15 stirring blades), circumferential speed of the tip portion of the stirring blade 2 of 50 m/sec., and dust concentration of 1 $Kg/m^3$. The residence time of the powder in the continuous mixing machine was about 2 to 3 seconds.

When the toner obtained was observed by an electron microscope, it could be confirmed that most of the silica fine powder was found to be dispersed to primary particles and attached uniformly on the surface of colored particles. No agglomerated body of free silica could be found.

The toner obtained was thrown into a copying machine NP3525 manufactured by Canon and development was carried out. As the result, a good image with an image density of 1.35 was obtained. No increase of fog was seen even when left to stand in an atmosphere temperature of 35° C. under a high humidity of 90% RH for 10 days.

COMPARATIVE EXAMPLE 1

100 Parts of the colored particles obtained similarly as in Example 1 and 0.3 parts by weight of silica fine powder were thrown into a mixer of the system shown in FIG. 8 (volume in the mixing vessel: 75 liters), and mixed at a circumferential speed of the tip portion of the stirring blade of 20 m/sec. for 3 minutes to obtain a toner. The total time of throwing time of the powder into the mixer, the mixing time and the take-out time of the toner from the mixer was about 5 minutes. Throughput for one time in the mixer shown in FIG. 8 was about 10 kg.

When the toner obtained was observed by an electron microscope, silica was found to be attached on the surface of colored particles under unloosened state, and also agglomerated mass of free silica was seen.

The toner obtained was thrown into the developing device of a copying machine NP270RE manufactured by Canon, fog was more conspicuous as compared with the toner obtained in Example 1, and fog was further increased when left to stand under an atmosphere temperature of 35° C. and a high humidity of 90% RH for 10 days.

COMPARATIVE EXAMPLE 2

100 Parts of the colored particles obtained similarly as in Example 3 and 0.4 part by weight of silica fine powder were thrown into a mixer of the system shown in FIG. 8, and mixed at a circumferential speed of 40 m/sec. for one minute to obtain a toner. Throughput for one time was about 10 kg.

When the toner obtained was observed by an electron microscope, silica was found to be attached on the surface of colored particles under unloosened state, and also agglomerated mass of free silica was seen.

The toner obtained was thrown into the developing device of a copying machine NP3525 manufactured by Canon, fog was more conspicuous as compared with the toner obtained in Example 3, and fog was further increased when left to stand under an atmosphere temperature of 35° C. and a high humidity of 90% RH for 10 days.

According to the process of the present invention as described above, by means of stirring blades provided in multiple stages, the colored particles and the additive can be surely mixed, whereby the additive is attached under the state sufficiently dispersed uniformly on the surface of the colored particles and therefore the triboelectric charging characteristics of the toner obtained are stabilized without influence from fluctuation in environmental conditions and no quality deterioration of the toner will be brought about in copying of a large number of sheets.

In the process of the present invention, since the additive such as silica is attached on the surface of colored particles under the state dispersed to primarily particles, those once attached will be freed with difficulty and therefore there is the advantage that no deterioration with lapse of time will occur even when the toner obtained may be left to stand for a long term. Since there is little agglomerated body of additive such as silica or fused product of colored particles, fog which may be considered to be caused by these particles is reduced. According to the process of the present invention, since an additive such as silica can be dispersed more finely to be attached on the surface of the colored particles, the amount of the additive to be added in the colored particles can be made smaller to effect reduction in cost.

We claim:

1. A process for producing a toner composition for developing electrostatic latent images comprising introducing colored particles having at least a binder resin, a colorant and a powdery additive for controlling the flowability of said colored particles and subject to agglomeration into a continous mixing device; and continuously mixing the colored particles and the powdery additive in a fluidized state in gaps between multiple stages of said continuous mixing device between opposed pairs of a fixed blade and a rotatable blade thereof to provide a circuitous, continuous mixing path for said colored particles and said powdery additive in order to finely disperse and fix the powdery additive on the surface of the colored particles and to stabilize the triboelectric charge characteristics thereof and to reduce agglomerates of said powdery additive, to obtain a toner composition.

2. A process according to claim 1, wherein the tip portion of the stirring blade rotates at a circumferential speed of 20 to 100 m/sec.

3. A process according to claim 1, wherein the tip portion of the stirring blade is rotating at a circumferential speed of 30 to 80 m/sec.

4. A process according to claim 1, wherein the mixture of the colored particles and the powdery additive is introduced into the mixing chamber at a dust concentration of 0.1 to 20 $Kg/m^3$.

5. A process according to claim 1, wherein the stirring blade rotates at 500 to 10,000 rpm.

6. A process according to claim 1, wherein the stirring blade rotates at 1,000 to 7,000 rpm.

7. A process according to claim 1, wherein the colored particles have a volume average particle size of 2 to 20 μm and the powdery additive is silica fine powder.

8. A process according to claim 1, wherein the colored particles and the powdery additive are preliminarily mixed before introduction into the continuous mixing device.

9. A process according to claim 1, wherein the colored particles have a volume average particle size of 2 to 20 μm, and the powdery additive has a primary particle size of 1 μm or less.

10. A process according to claim 1, wherein the colored particles and the powdery additive are mixed in the mixing device while residing for several seconds therein.

11. A process according to claim 1 including providing a plurality of three or more communicating stirring zones formed by the opposed pairs of fixed and rotatable blades.

* * * * *